United States Patent [19]

Knaup et al.

[11] Patent Number: 4,752,769

[45] Date of Patent: Jun. 21, 1988

[54] INFRARED MOTION ALARM

[75] Inventors: Gerhard Knaup, Laudenbach; Fred Plotz; Norbert Schaaf, both of Wiesbaden, all of Fed. Rep. of Germany

[73] Assignee: Heimann GmbH, Fed. Rep. of Germany

[21] Appl. No.: 903,026

[22] Filed: Sep. 2, 1986

[30] Foreign Application Priority Data

Sep. 2, 1985 [DE] Fed. Rep. of Germany ..... 3531333

[51] Int. Cl.[4] ..... G08B 13/18

[52] U.S. Cl. ..... 340/567; 250/342; 250/353

[58] Field of Search ..... 340/567, 552; 250/342, 250/353; 358/113, 87, 108, 139; 350/1.1, 627

[56] References Cited

U.S. PATENT DOCUMENTS

| | | | |
|---|---|---|---|
| 3,631,434 | 12/1971 | Schwartz | 340/567 |
| 3,703,718 | 11/1972 | Berman | 340/567 |
| 3,703,718 | 11/1972 | Berman | 340/567 |
| 3,766,539 | 10/1973 | Bradshaw et al. | 340/567 |
| 4,321,594 | 3/1982 | Galvin et al. | 340/567 |
| 4,429,224 | 1/1984 | Wägli et al. | 250/342 |
| 4,588,988 | 5/1986 | Karas | 340/552 |
| 4,612,442 | 9/1986 | Toshimichi | 250/353 |

FOREIGN PATENT DOCUMENTS

| | | |
|---|---|---|
| 0050751 | 5/1982 | European Pat. Off. . |
| 3235250 | 3/1984 | Fed. Rep. of Germany . |

*Primary Examiner*—Joseph A. Orsino
*Assistant Examiner*—Thomas J. Mullen, Jr.
*Attorney, Agent, or Firm*—Hill, Van Santen, Steadman & Simpson

[57] ABSTRACT

The invention is directed to an infrared motion alarm characterized by an infrared detector and an optical arrangement before the detector in the radiation direction for focussing the infrared radiation onto the detector. The optical arrangement is formed by a mirror arrangement and by a lens arrangement with the mirrors being on different levels so the different beam paths are being detected to prevent an intruder from crawling under the infrared detection beam paths.

3 Claims, 4 Drawing Sheets

INFRARED MOTION ALARM

BACKGROUND OF THE INVENTION

The present invention is directed to an infrared motion alarm comprising an infrared detector and an optical arrangement preceding the detector in the radiation direction for focussing the infrared radiation onto the detector. The optics are formed by a lens arrangement adjacent the detector and a mirror arrangement which will reflect the radiation through the lens into the detector.

An infrared motion alarm, which has an infrared detector and an optical arrangement for focussing infrared radiation into the detector, will serve for an excursion or burgular alarm. However, there is a demand for protection against crawling under the sensed beam of radiation or in other words, to determine movement below a detection zone for the motion alarm if possible so that the detection zone will proceed from wall to wall with an aperture angle of 180°.

Infrared motion alarms are known which are composed of a combination of a mirror and lens arrangement. Examples are U.S. Pat. Nos. 3,766,539 and 3,631,434 and the disclosures of these two patents are incorporated by reference thereto. As a consequence of the simple design of these known infrared motion alarms and the acquisition of the radiation in only one plane; however, faultless protection against a crawling individual under the path of detected rays is therefore not guaranteed.

SUMMARY OF THE INVENTION

The object of the present invention is to provide an infrared motion alarm which has a detector with a lens and mirror arrangement for focussing light into the detector which will provide reliable protection against an intruder crawling under the beam of radiation being detected.

To accomplish this object, the alarm of the present invention has a plurality of optics which are arranged in a plurality of different planes or levels. Due to the series connection of a mirror and of the lens arrangement and the suitable arrangement in a plurality of planes, it is possible to acquire infrared radiation from such a large region that crawling under the paths or beams of radiation being directed to the motion alarm is impossible. The lens arrangement can thereby be formed by a Fresnel lens.

DESCRIPTION OF THE PREFERRED EMBODIMENTS

Figure 1:
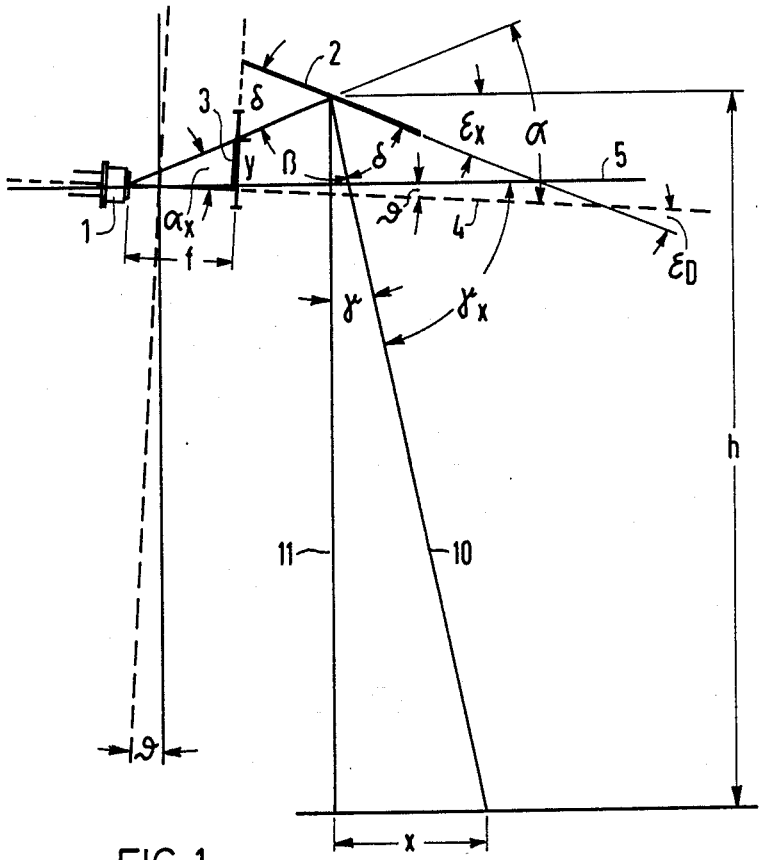
FIG. 1 is a schematic side view of a motion alarm of the present invention.

The principles of the present invention are particularly useful when incorporated into an infrared alarm system as diagramatically illustrated in FIG. 1. The alarm system has an infrared detector 1 which receives infrared radiation via optics which are formed by a mirror 2 and by a Fresnel lens 3, which is arranged to follow the mirror in the direction of movement of the radiation and precedes the infrared detector 1. In other words, the lens 3 is located between the detector 1 and the mirror 2. The infrared detector has its axis 4 inclined by an angle $\theta$ relative to a horizontal line 5. The angle of inclination of the mirror relative to the horizontal line 5 is referenced $\epsilon_x$ and its angle of inclination relative to the axis 4 of the detector 1 is $\epsilon_D$. The reflection angle of the mirror 2 has a designation $\beta$ and $\delta$ and the angle of incident of the radiation into the infrared detector has the designation $\alpha_x$. The focal length of the Fresnel lens 3 is referenced f and as illustrated, the focal point lies on the surface of the detector 1. The height of a central axis of the mirror 2 in the room is h.

A beam 10 emitted from an object at a distance x from a vertical line 11 through a central axis of the mirror 2 at an angle $\gamma$ is deflected into the Fresnel lens 3 via the mirror 2 and is impinged on the infrared detector 1 at an angle $\alpha_x$. By variation of the mirror's inclination relative to the horizontal line 5, in other words, changing the angle $\epsilon_x$, the range x or, respectively, the angle of incidence can be set. Given an angle $\epsilon_x=25°$ and $\alpha_x=21.25°$, a range of 0.5 m will be obtained. A faultless detection against crawling under the infrared beam 10 is thereby guaranteed.

Figure 2:
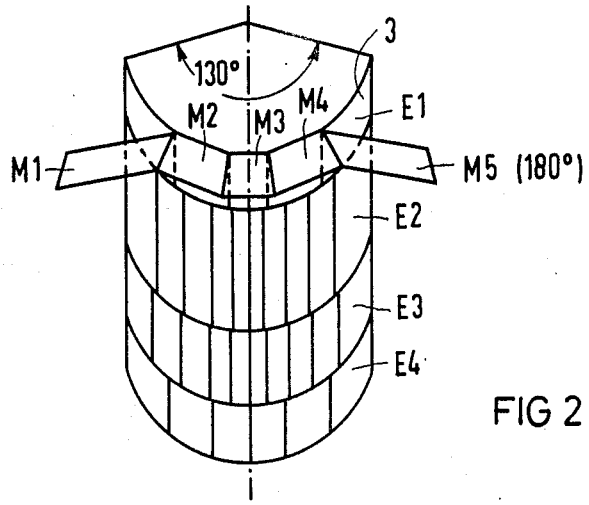
FIG. 2 is a perspective view of an embodiment of the motion alarm of the present invention.

FIG. 2 is a perspective of a lens/mirror combination wherein planes E2, E3 and E4 are different levels or planes containing optical elements with the optical elements in each of the planar levels lying in different relationships relative to each other. In level E1, the mirror segments M1–M5 are combined with the Fresnel lens 3 and this plane E1 serves as a protection against crawling under the infrared beams. The mirror segments M1 and M5 are positioned from the Fresnel lens 3 in order to expand the original angle of view from approximately 130° to near 180°.

Figure 3:
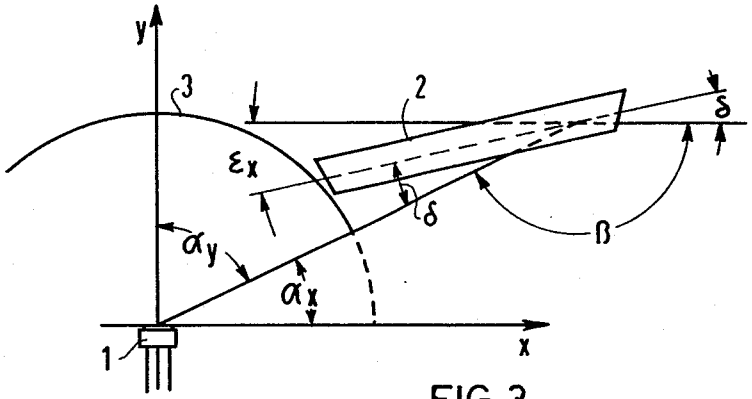
FIG. 3 is a top schematic view of the motion alarm of FIG. 1.

FIG. 3 shows the course of a beam 10 of the motion alarm from a plan view. Accordingly, the x and y axis are illustrated whereas the z axis which extends vertically in the room lies perpendicular to the plane of the drawing. The angle of the incidence radiation to the y axis $\alpha_y$ is illustrated.

The beam 10 from an object strikes the mirror 2 parallel to the x axis (180° acquisition angle) and is deflected by this mirror into the Fresnel lens 3 so that it impinges on the infrared detector 1 at an angle $\alpha_y$. The angle $\alpha_y$ dare not be greater than half the angle of view of the Fresnel lens 3. The acquisition angle of the lens/-mirror combination can be arbitrarily set by variations of the angle of incidence $E_x$.

Figure 4:
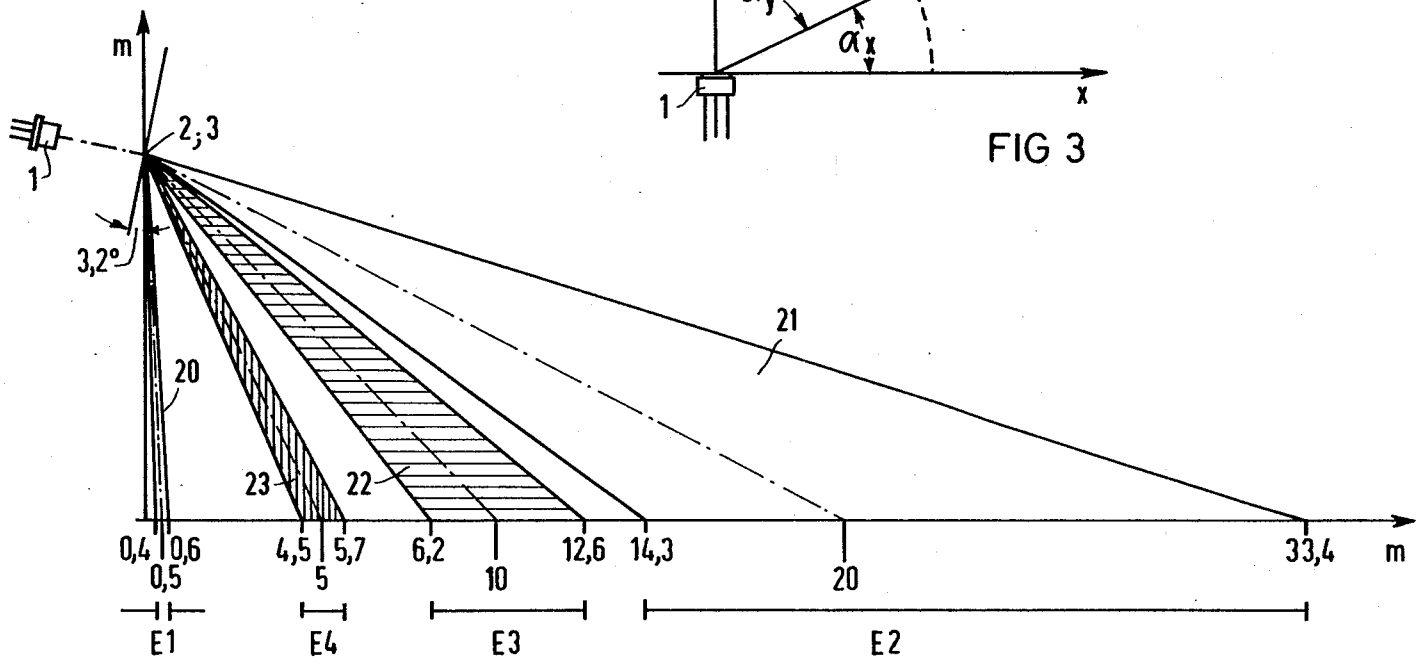
FIG. 4 is a graphical representation taken in a vertical plane of the ranges of the various individual beams of radiation for the device of FIG. 2.

FIG. 4 illustrates a range of individual beams from different planes or levels E1 through E4 with the level E1 having beam 20, E2 having beam 21, E3 having beam 22 and E4 having beam 23 for the device of FIG. 2. The lens/mirror combination is thereby referenced 2, 3. Also, proceeds from FIG. 4 that a acquisition of infrared radiation coming from an object is guaranteed up to a distance of about 0.4 m from the vertical of the motion alarm.

Figure 5:
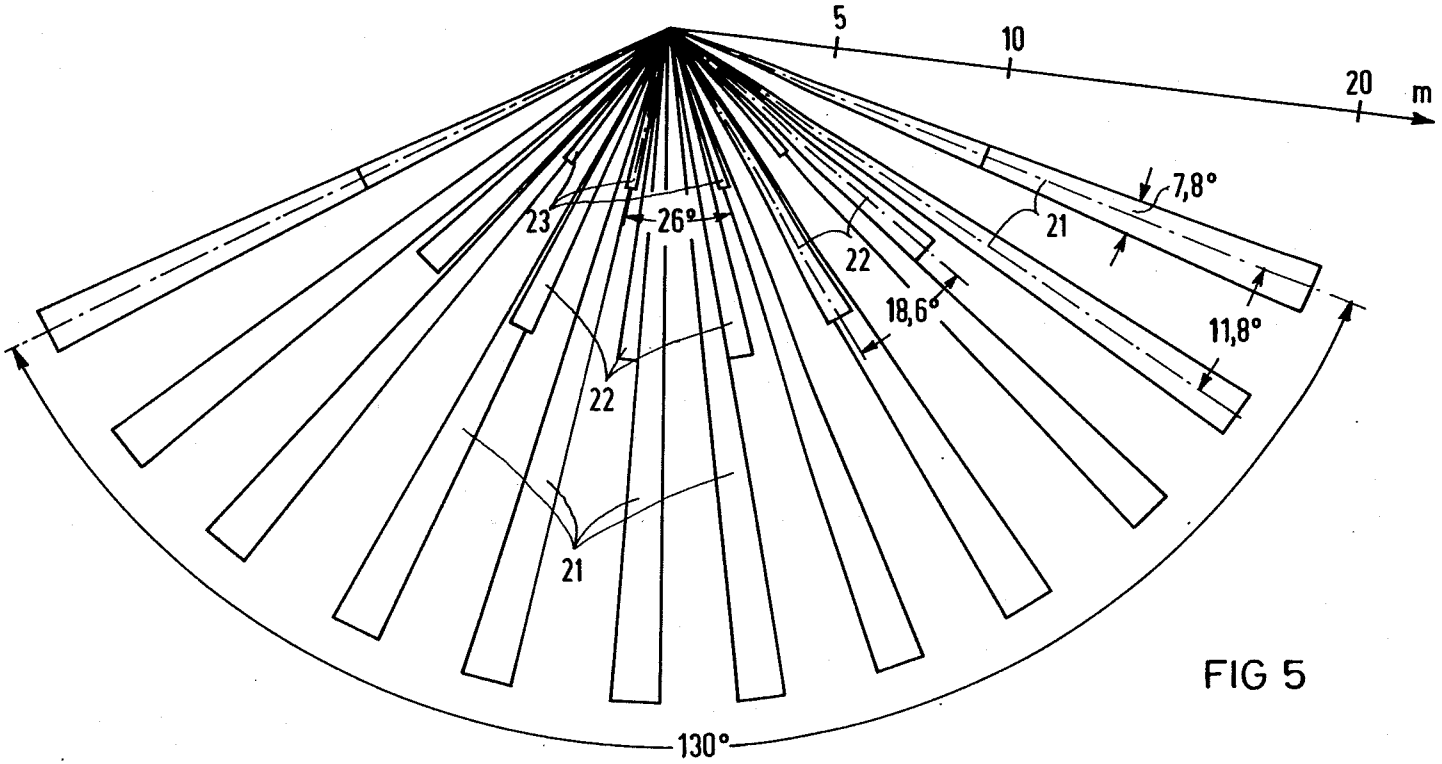
FIG. 5 is a planar representational view of the various paths of radiation and distances from a vertical axis for the device of FIG. 2.

In FIG. 5, the beams 21, 22 and 23 from the planes or levels E2, E3 and E4 are illustrated. They include beams 23 from The plane E4 of which there are six that have a spacing of 26° between two adjacent beams 23. There are eight beams 22 from the level E3 and these have a distance or spacing of approximately 18.6° between their axes. There are twelve beams 21 from the level E2 and they have an angular spacing between their axes of 11.8° and width of approximately 7.8°. The other beams 22 and 23 also have the same width of approximately 7.8°.

Figure 6:
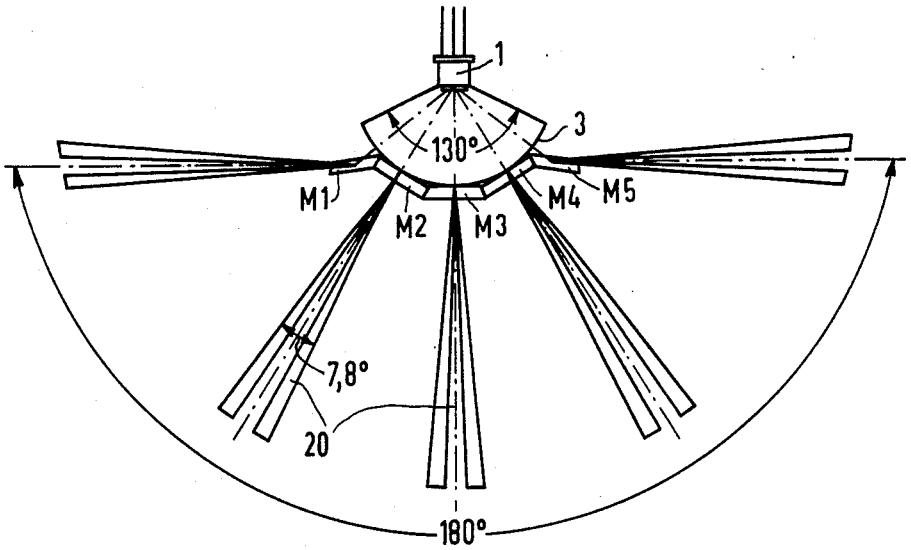
FIG. 6 is a plan view of the beams from a single level which beams are expanded to cover 180° for the device of FIG. 2.

In FIG. 6, a distribution of beams 20 of level E1 is illustrated and the figure shows the various mirrors M1, M2, M3, M4 and M5 which coact with the lens 3 to produce the expanded beams over 180°. Each of these beams also have a width of approximately 7.8°.

Although various minor modifications may be suggested by those versed in the art, it should be understood that we wish to employ within the scope of the patent granted hereon, all such modifications as reasonably and properly come within the scope of our contribution to the art.

We claim:

1. In an infrared motion alarm for monitoring infrared radiation, said alarm comprising a single infrared detector and an optical arrangement located in front of the detector in a monitoring direction for focussing the infrared radiation onto the detector, the improvements comprising the optical arrangement being formed by a plurality of mirrors and a single lens arrangement, said lens arrangement being disposed between the mirrors and the single detector, said mirrors being arranged in a plurality of different levels with a plurality of mirrors in each level, each of the mirrors directing a beam of infrared radiation from a given location to the lens arrangement so that a large angle of acquisition in two orthogonal directions can be monitored by the single detector.

2. In an infrared motion alarm according to claim 1, wherein the lens arrangement is formed by a Fresnel lens.

3. In an infrared motion alarm according to claim 1, wherein all of the locations for the mirrors lie on arcs with the locations of the mirrors of one level being on an arc of a different radius than an arc for the locations of the mirrors of another level.

* * * * *